US005775401A

United States Patent [19]

Faurie

[11] Patent Number: 5,775,401

[45] Date of Patent: Jul. 7, 1998

[54] DRAPERY TIE BACK RINGS

[76] Inventor: Vickie A. Faurie, 9216 S. 92nd East Ave., Tulsa, Okla. 74133

[21] Appl. No.: 486,332

[22] Filed: Jun. 7, 1995

[51] Int. Cl.[6] ..... A47H 19/00

[52] U.S. Cl. ..... 160/349.2; 211/16; 248/315

[58] Field of Search ..... 160/349.1, 349.2, 160/348, 330; 211/16, 88, 91, 71, 100, 181, 99; D6/546, 547, 548; 248/315, 291.1

[56] References Cited

U.S. PATENT DOCUMENTS

| | | | |
|---|---|---|---|
| D. 248,803 | 8/1978 | Newton | D6/546 X |
| D. 346,295 | 4/1994 | Wilson et al. | D6/546 |
| 550,791 | 12/1895 | Huebel | 211/99 |
| 691,368 | 1/1902 | East | 211/99 |
| 1,545,122 | 7/1925 | Brown | 211/99 |
| 1,654,002 | 12/1927 | Kleinhamer . | |
| 1,868,944 | 7/1932 | Jones . | |
| 1,995,980 | 3/1935 | Haymond | 211/99 |
| 2,199,717 | 5/1940 | Thoms | 156/33 |
| 2,236,017 | 3/1941 | Stratton | 160/349.2 X |
| 2,244,129 | 6/1941 | Stratton | 160/349.2 X |
| 2,251,512 | 8/1941 | Bush et al. | 156/33 |
| 2,259,166 | 10/1941 | Kendrick | 211/99 X |
| 2,329,446 | 9/1943 | Whitehead et al. | 160/349 |
| 2,337,950 | 12/1943 | Werner et al. | 160/330 |
| 2,431,934 | 12/1947 | Higgins | 160/349.2 |
| 2,470,233 | 5/1949 | Boye | 160/330 |
| 2,701,114 | 2/1955 | Donaldson | D6/546 X |
| 4,343,344 | 8/1982 | Shelton | 160/349 |
| 4,559,988 | 12/1985 | Nocerino | 160/349 |
| 4,637,582 | 1/1987 | Boda | D6/546 X |
| 5,141,045 | 8/1992 | Williams | 160/349.1 X |

*Primary Examiner*—David M. Purol
*Attorney, Agent, or Firm*—Head, Johnson & Kachigian

[57] ABSTRACT

A curtain tie back arrangement uses a plurality of pivotal and variably spaced rings through which the drapery material is decoratively laced.

8 Claims, 4 Drawing Sheets

DRAPERY TIE BACK RINGS

BACKGROUND OF THE INVENTION

1. Field of the Invention

This invention relates generally to drapery tie back apparatus.

2. Background and Description of the Art

A common installation of draperies for windows or other decorative purposes comprises draperies which are usually pleated and hung vertically from some form of curtain rod support. The draperies are spaced from the wall or window with the vertical hanging portion of the draperies turning inwardly toward the wall. When tie backs are used, the tie back has most often been attached at one end to a hook or the like, with the tie back extending around the drapery which pulls the pleats toward the hook with the opposite end of the tie back being engaged usually with same hook or one located adjacent thereto.

One effort to hold drapery material in the conventional tie back manner is shown in U.S. Pat. No. 2,251,512. Other forms of tie back devices used to maintain the vertical pleats or folds of the curtains in spaced relation have been shown in the U.S. Pat. Nos. 1,868,944; 1,654,002; 4,343,344; 4,559,988; and 2,199,717. Festoon rings and brackets for holding drapery material have been taught in U.S. Pat. Nos. such as 2,337,950; 2,329,446; and 2,470,233.

SUMMARY OF THE INVENTION

An important object of this invention is to provide a drapery tie back or retainer which will maintain the drapery in a unique gathered position that provides an attractive result.

A further specific object of the invention is to provide a unique tie back formed of supportive base member to which a plurality of spaced rings are connected, the base member being attachable to a window frame or wall as desired.

Another object of the invention is to provide a drapery tie back wherein a plurality of pivotal ring members which can be moved to a variety of vertical positions along a base member with the drapery material being decoratively laced and gathered through and around the rings.

DETAILED DESCRIPTION OF THE PREFERRED EMBODIMENT

Figure 1:
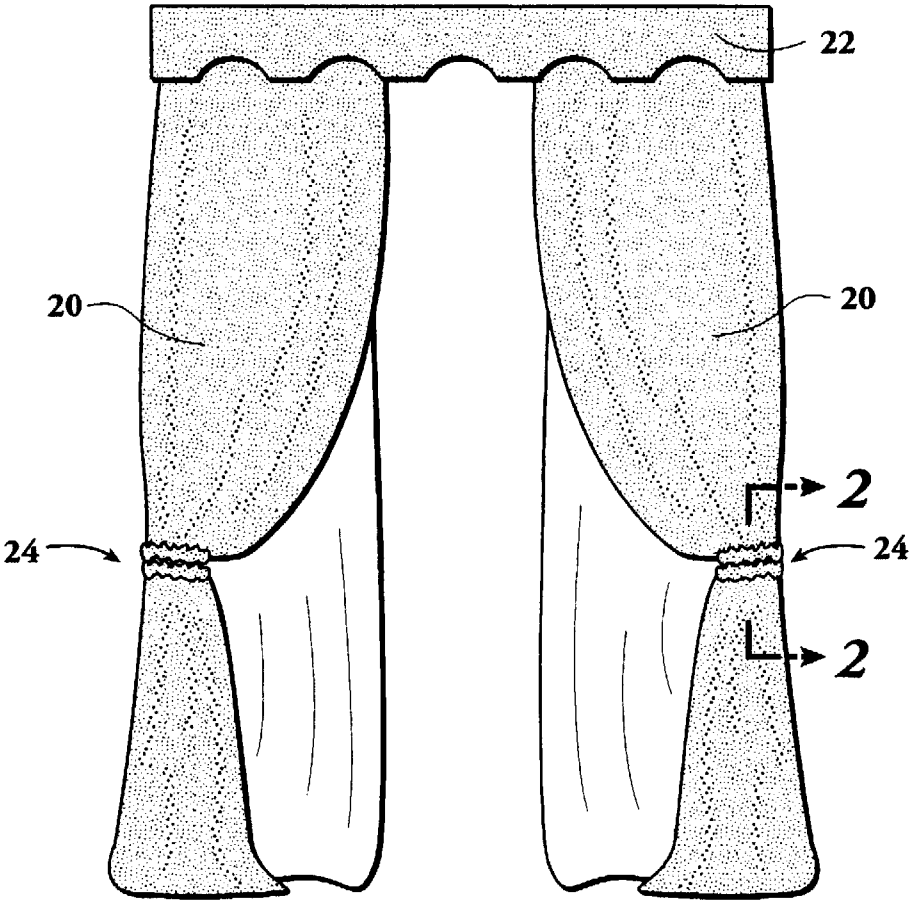
FIG. 1 is a front elevational view of a drapery configuration utilizing the tie back of this invention.

FIG. 1 represents a typical curtain and drapery installation wherein the drapery material 20 is supported at the top by a curtain rod, not shown in this view, which may be covered by a cornice board 22. The tie back arrangement of this invention is generally designated by the numeral 24.

Figure 2:
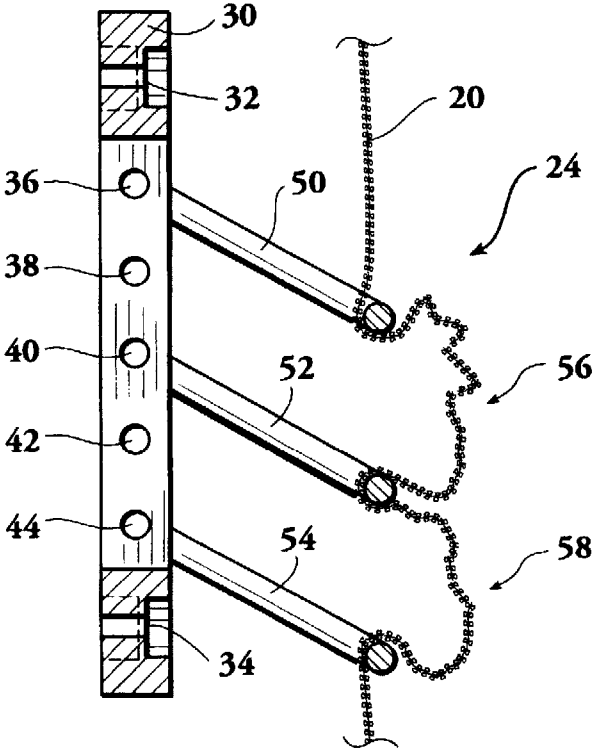
FIG. 2 is a sectional view of the tie back taken along the line 2—2 of FIG. 1.

Referring now to FIG. 2, the apparatus of this invention is shown to include a base member 30 having openings 32 and 34 to receive some form of fastener for supporting the base member through the wall or window frame as desired. A plurality of pairs of openings 36, 38, 40, 42, and 44 are provided longitudinally along each side of the base member to receive ring members 50, 52, and 54 through which the drapery material is laced, as shown, around the topmost ring 50 and then 'puffed' or gathered, as generally designated at 56, thence back around ring 52 forming additional 'puffed' or gathered material 58 and thence back around the bottom-most ring 54 as shown.

Figure 5:
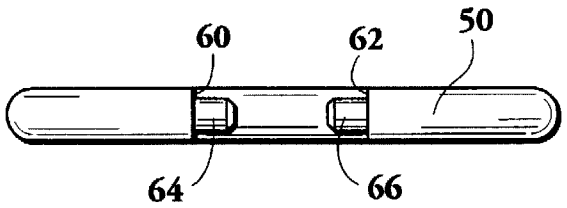
FIG. 5 is a side elevational view of the ring of FIG. 4.
Figure 4:
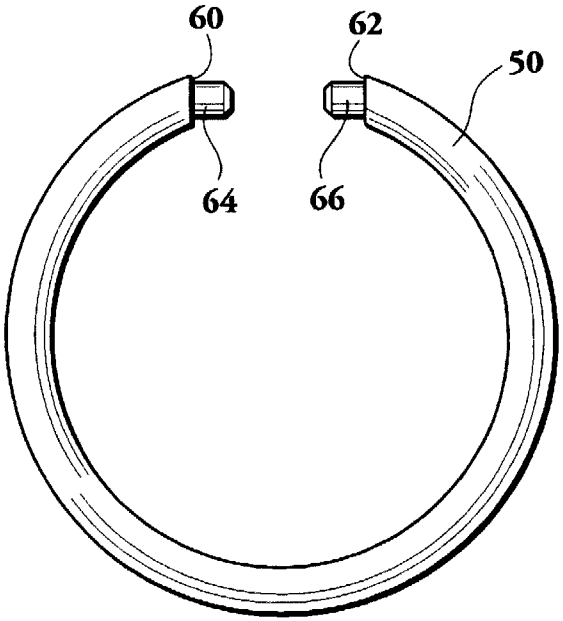
FIG. 4 is a elevational view of a typical ring used in this invention.
Figure 3:
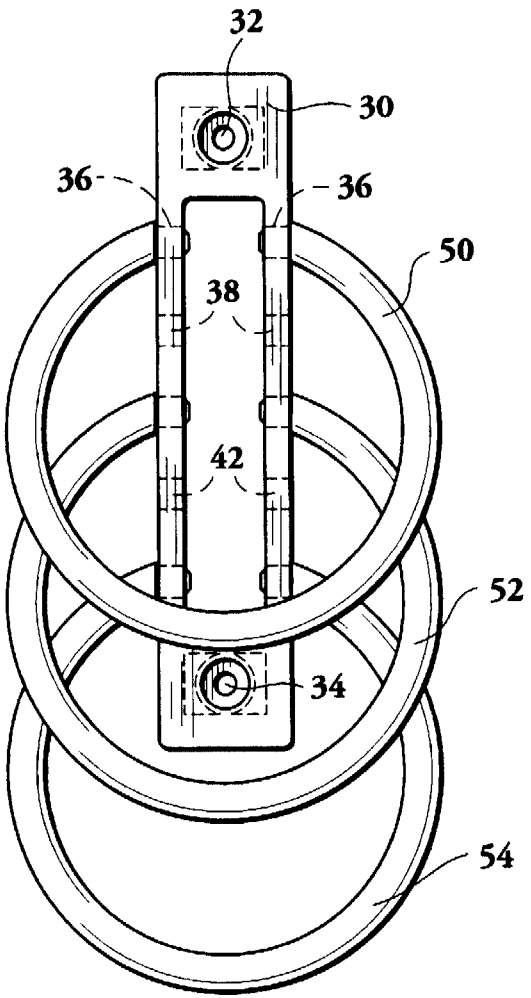
FIG. 3 is a front elevational view of the tie back apparatus of this invention.

Referring now to FIGS. 3, 4 and 5, a typical ring 50, for example, is usually composed of a plastic or metal material with a ring having split ends 60 and 62 with a smaller diameter respective lobes 64 and 66 which are adapted with some resiliency to allow the ring to spring apart, that is, i.e., being normally biased inwardly, and connected to the receiving openings 36, 38, 40, 42, and 44. That is, the distance between the split ends is less than the width of the base member so that the rings will be retained to the base member. Although the receiving openings have been shown as holes for receiving the lobes 64 and 66 therein, it is to be understood that other forms of receiving slots or connection means can be utilized in order to practice the invention of providing a plurality of rings which will pivot relative to the base member. In another embodiment, provision is made for the rings to be longitudinally moved to any desired spacing between the rings. Although three rings have been shown in these views, it is to be understood that additional rings could be utilized or fewer rings can be utilized to provide the desired decorative effect.

Figure 7:
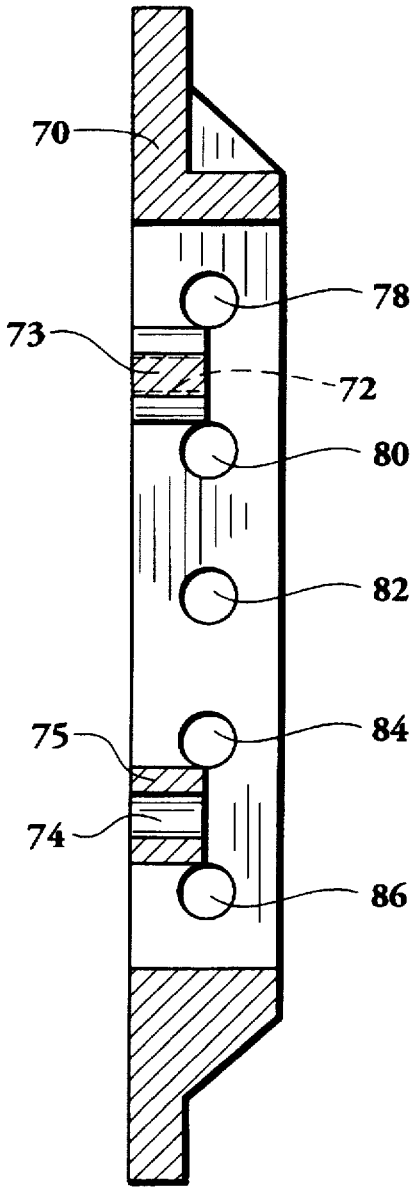
FIG. 7 is a sectional view taken along the line 7—7 of FIG. 6.
Figure 6:
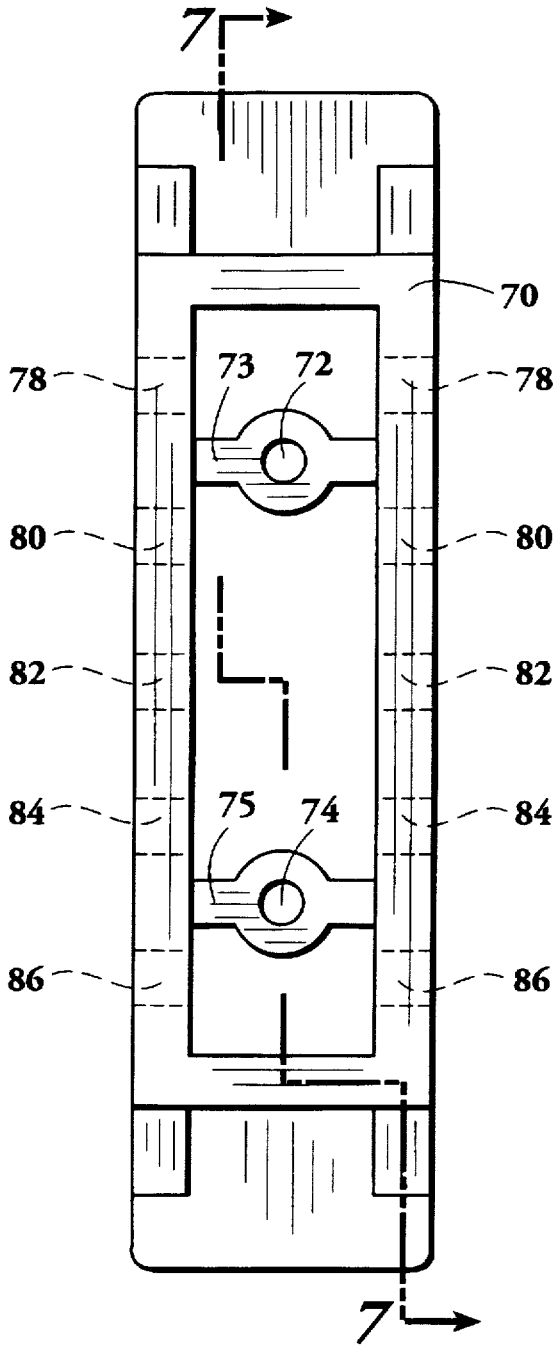
FIG. 6 is a front elevational view of a modified form of base member.
Figure 8:
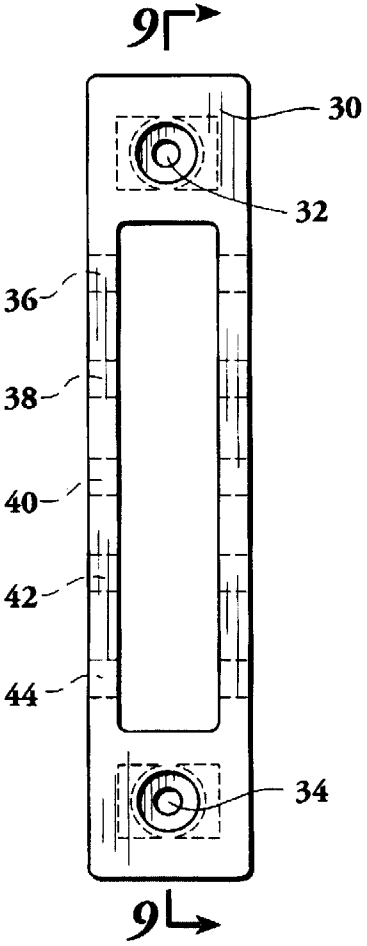
FIG. 8 is a front elevational view of a modified form of wall bracket or base member.
Figure 9:
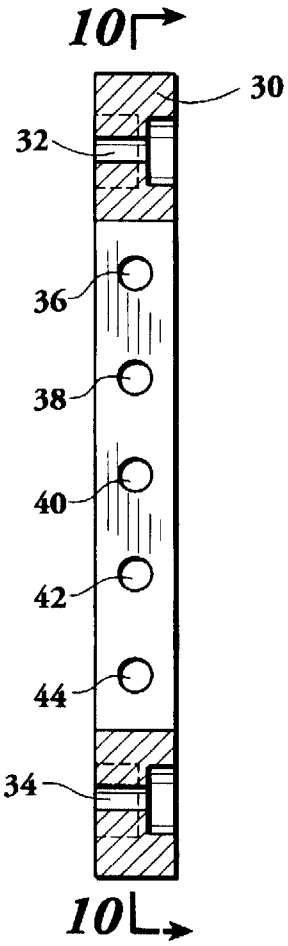
FIG. 9 is a sectional view taken along the line 9—9 of FIG. 8.
Figure 10:
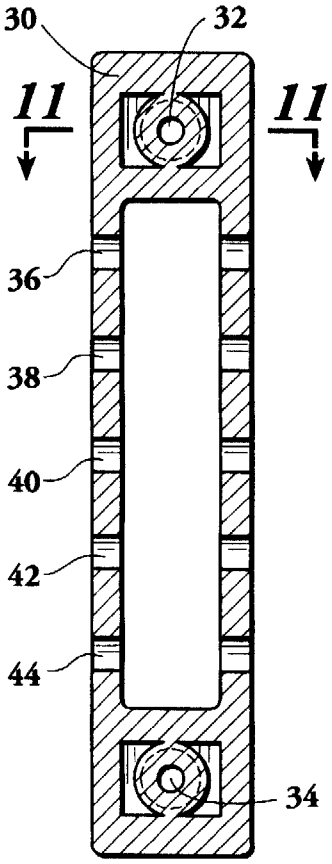
FIG. 10 is a sectional view taken along the line 10—10 of FIG. 9.
Figure 11:
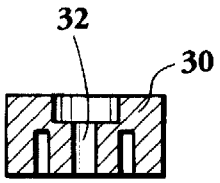
FIG. 11 is a sectional view taken along the line of 11—11 of FIG. 10.

FIG. 6 and 7 depict an alternate form of base member of the invention wherein it is desirable to hide the attachment mechanism to the wall or window frame. In this embodiment, a decorative base member 70 includes openings 72 and 74 which are provided within respective cross-over brackets 73 and 75 to receive appropriate fasteners which will be hidden from view when the decorative effect of the invention is utilized. Similar to the previous base member, a plurality of longitudinal openings 78, 80, 82, 84, and 86 are provided along each side of the base member 70 to receive the pivotal rings as shown.

FIGS. 8, 9, 10 and 11 represent additional views of the base of the type shown in FIGS. 2 and 3 where like numerals are used.

Although the invention has been described herein particularly, other modifications would include the use of adhesives to attach the base members 30 or 70 to the wall or window frame in lieu of threaded fasteners. In addition, although round rings have been shown in these views, it is understood that other shapes of rings, oval, rectangular, or other decorative form can be used to achieve a variety of decorative effects.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled. For instance, the device of this invention can have other uses, e.g., as a multiple towel holder.

What is claimed is:

1. A device of the character described comprising:

a base member having a pair of longitudinal side edges, means to attach said member to a surface, a plurality of spaced receiving means along each said side edge;

a plurality of unitary rings, each ring having split ends, each of said ends capable of being removably retained in selected of said receiving means.

2. The device of claim 1 wherein said means to attach said member to a surface comprises threaded fasteners in spaced openings in said base member.

3. A drapery tie back device comprising:

a base member having side edges and a plurality of longitudinally spaced receiving means along each said side edge, said base member having a means to attach to a wall or window frame surface;

a plurality of unitary rings, each ring having split ends, each of said ends capable of being removably and pivotally retained in said receiving means whereby a drapery can be decoratively laced through and around said rings.

4. The tie back of claim 3 wherein said receiving means comprise a plurality of openings; and said split ends of said rings include lobes to be received within said openings.

5. The tie back of claim 4 wherein said split ends of each ring are biased inwardly.

6. The tie back of claim 3 wherein said means to attach said member to a surface comprises threaded fasteners in spaced openings in said base member.

7. The tie back of claim 4 wherein said openings are equally spaced between a topmost and bottommost of said side edges.

8. The tie back of claim 3 wherein said means to attach said member is by glue means.

* * * * *